US005834718A

United States Patent [19]

Amonett

[11] Patent Number: 5,834,718

[45] Date of Patent: Nov. 10, 1998

[54] APPLIANCE TIMER HAVING A SWITCHING MECHANISM FOR HIGH-CURRENT CARRYING CIRCUIT BLADES AND ASSOCIATED METHOD

[75] Inventor: Daniel K. Amonett, Indianapolis, Ind.

[73] Assignee: Emerson Electric Co., St. Louis, Mo.

[21] Appl. No.: 805,839

[22] Filed: Mar. 3, 1997

[51] Int. Cl.[6] ..... H01H 43/10

[52] U.S. Cl. ..... 200/38 R; 200/38 B

[58] Field of Search ..... 200/19 R, 23, 200/24, 27 R, 28, 30 R, 33 R, 35 R, 36, 37 R, 37 A, 33 B, 38 R–38 DC

[56] References Cited

U.S. PATENT DOCUMENTS

| | | | |
|---|---|---|---|
| Re. 29,158 | 3/1977 | Cartier et al. | 200/38 B |
| 3,018,340 | 1/1962 | Eggert et al. | 200/38 |
| 3,700,837 | 10/1972 | Schulze-Berge | 200/38 R |
| 3,814,874 | 6/1974 | Brown | 200/38 B |
| 3,823,280 | 7/1974 | Obermann et al. | 200/38 B |
| 4,123,915 | 11/1978 | Stoor | 62/234 |
| 4,531,028 | 7/1985 | Stout et al. | 200/38 R |
| 4,536,627 | 8/1985 | Duve | 200/38 R |
| 4,551,590 | 11/1985 | Mahon | 200/38 R |
| 4,560,846 | 12/1985 | Klopp et al. | 200/38 R |
| 4,677,260 | 6/1987 | Nagasaki et al. | 200/6 BB |
| 4,734,548 | 3/1988 | Cole | 200/38 R |
| 4,892,983 | 1/1990 | Bogda et al. | 200/38 R |
| 4,912,939 | 4/1990 | Obermann et al. | 62/233 |
| 5,637,843 | 6/1997 | Joyce et al. | 200/38 R |

*Primary Examiner*—Michael A. Friedhofer
*Attorney, Agent, or Firm*—Mark D. Becker

[57] ABSTRACT

A timer for controlling an appliance includes a cam having a first cam surface and a second cam surface defined therein. The first cam surface is distinct from the second cam surface. The timer also includes a first circuit blade which cooperates with the first cam surface so as to moved between a first neutral position and a first actuated position. The timer further includes a second circuit blade which cooperates with the second cam surface so as to moved between a second neutral position and a second actuated position. Moreover, the timer includes a third circuit blade which is positionable in a first offset position and a second offset position. The third circuit blade is positioned at the first offset position when the first circuit blade is positioned at the first actuated position. The third circuit blade is moved from the first offset position to the second offset position when the first circuit blade is moved from the first actuated position to the first neutral position. The third circuit blade contacts the second circuit blade when the third circuit blade is positioned in the second offset position and the second circuit blade is positioned in the second actuated position. A method of operating an appliance timer is also disclosed.

17 Claims, 7 Drawing Sheets

APPLIANCE TIMER HAVING A SWITCHING MECHANISM FOR HIGH-CURRENT CARRYING CIRCUIT BLADES AND ASSOCIATED METHOD

BACKGROUND OF THE INVENTION

The present invention relates generally to timing devices, and more specifically to an appliance timer having a switching mechanism for high-current carrying circuit blades.

Appliance timers are commonly used in many household appliances, such as dishwashers, clothes washers, and clothes dryers. The appliance timer controls operation of the appliance by actuating and deactuating switch assemblies which start and stop various work functions within the appliance such as a rinse function in the case of a clothes washer. The switch assemblies within the appliance timer are actuated and deactuated as a result of interaction between a number of a cam surfaces defined in a camstack of the appliance timer and a number of cam followers which are respectively associated with the switch assemblies.

Each of the switch assemblies typically includes an upper circuit blade and a lower circuit blade with an intermediate circuit blade positioned therebetween. A first end of each of the upper, lower, and intermediate circuit blades includes a terminal which is electrically coupled to components associated with the appliance such as a main machine motor and a power supply.

A second end of each of the upper, lower, and intermediate circuit blades cooperates with the camstack of the appliance timer. More specifically, the upper circuit blade and the lower circuit blade are generally passive, whereas the intermediate circuit blade is generally active. In particular, the second end of the lower circuit blade has a blade support molded thereto. A bottom edge of the blade support contacts a portion of the camstack which does not have a varying cam surface defined therein. Therefore, as the camstack rotates, the lower circuit blade is not moved upwardly or downwardly. Moreover, a top edge of the blade support supports the second end of the upper circuit blade. Hence, rotation of the camstack does not cause the upper circuit blade to be moved upwardly or downwardly.

However, the intermediate circuit blade includes a cam follower which cooperates with a cam surface defined in the camstack. When the cam follower encounters a drop defined in the cam surface, the intermediate circuit blade is placed into electrical contact with the lower circuit blade. More specifically, the intermediate circuit blade includes an electrical contact that is urged into contact with a similar electrical contact included in the lower circuit blade when the intermediate circuit blade is dropped onto the lower circuit blade. To subsequently break the electrical contact between the intermediate circuit blade and the lower circuit blade, a cam lift is defined in the cam surface which lifts the cam follower of the intermediate circuit blade back to its original position.

In order to place the intermediate circuit blade in electrical contact with the upper circuit blade, a cam lift (as opposed to a drop) is defined in the cam surface of the camstack. As the camstack is rotated, the cam follower of the intermediate circuit blade is advanced up the cam lift of the cam surface thereby placing the intermediate circuit blade into electrical contact with the upper circuit blade. More specifically, the electrical contact of the intermediate circuit blade is urged into contact with a similar electrical contact included in the upper circuit blade when the intermediate circuit blade is lifted into contact with the upper circuit blade. To subsequently break the electrical contact between the intermediate circuit blade and the upper circuit blade, a drop is defined in the cam surface which drops the cam follower of the intermediate circuit blade back to its original position.

One drawback associated with such switching configuration is that switching operations associated with some work functions may require dropping the intermediate circuit blades onto the lower circuit blade, as opposed to lifting the intermediate circuit blade into contact with the upper circuit blade. In particular, it is preferred to actuate the main machine motor of the appliance by dropping the intermediate circuit blade onto the lower circuit blade rather than lifting the intermediate circuit blade into contact with the upper circuit blade. This is true since the relatively slow lifting action associated with lifting a circuit blade into contact with another circuit blade results in the presence of a relatively small amount of contact force between the two circuit blades at the point in time in which an electrical connection between the two circuit blades is first established. Such a relatively small amount of contact force between the two circuit blades may cause arcing which results in excessive wear and erosion of the circuit blades. This is especially true when the two circuit blades are associated with actuating the main machine motor of the appliance.

Hence, appliance timers which have heretofore been designed disadvantageously require circuit blade switching associated with high-current operations, such as main machine motor operation, to be performed by dropping the intermediate circuit blade onto the bottom circuit blade. This reduces the flexibility of the appliance timer since the top circuit blades cannot be used for such switching.

What is needed therefore is an appliance timer that includes a switching mechanism that enables an upper circuit blade to be utilized for switching of high-current operations. What is also needed is an appliance timer that reduces erosion and wear of the circuit blades thereof during the useful life of the appliance timer.

SUMMARY OF THE INVENTION

In accordance with a first embodiment of the present invention, there is provided a timer for controlling an appliance. The timer includes a cam having a first cam surface and a second cam surface defined therein. The first cam surface is distinct from the second cam surface. The timer also includes a first circuit blade which cooperates with the first cam surface so as to moved between a first neutral position and a first actuated position. The timer further includes a second circuit blade which cooperates with the second cam surface so as to moved between a second neutral position and a second actuated position. Moreover, the timer includes a third circuit blade which is positionable in a first offset position and a second offset position. The third circuit blade is positioned at the first offset position when the first circuit blade is positioned at the first actuated position. The third circuit blade is moved from the first offset position to the second offset position when the first circuit blade is moved from the first actuated position to the first neutral position and the second circuit blades is positioned at the second actuated position. The third circuit blade contacts the second circuit blade when the third circuit blade is positioned in the second offset position and the second circuit blade is positioned in the second actuated position.

In accordance with a second embodiment of the present invention, there is provided a method of operating an appliance timer. The method includes the steps of (a) moving a first circuit blade from a first neutral position to a first actuated position so as to cause movement of a third circuit blade from a third neutral position to a first offset position, (b) moving a second circuit blade from a second neutral position to a second actuated position, and (c) moving the first circuit blade from the first actuated position to the first neutral position when the second circuit blade is positioned at the second actuated position so as to cause movement of the third circuit blade from the first offset position to a second offset position such that the third circuit blade contacts the second circuit blade.

In accordance with a third embodiment of the present invention, there is provided a method of operating an appliance timer. The method includes the steps of (a) providing a camstack having a first cam surface and a second cam surface which are distinct from each other, the first cam surface including a first cam lift defined therein, and the second cam surface including a second cam lift defined therein, (b) rotating the camstack so that the first cam lift contacts a first cam follower of a first circuit blade so as to cause the first circuit blade to be moved from a first neutral position to a first actuated position, (c) rotating the camstack so that the second cam lift contacts a second cam follower of a second circuit blade so as to cause the second circuit blade to be moved from a second neutral position to a second actuated position, (d) moving a third circuit blade from a third neutral position to a first offset position in response to step (b), (e) rotating the camstack so that the first cam lift is advanced out of contact with the first cam follower of the first circuit blade after step (b) so as to cause the first circuit blade to be moved from the first actuated position to the first neutral position, and (f) moving the third circuit blade from the first offset position to a second offset position in response to step (e) while the second circuit blade is located at the second actuated position.

It is therefore an object of the present invention to provide a new and useful timer for controlling an appliance.

It is a further object of the present invention to provide an improved timer for controlling an appliance.

It is more over an object of the present invention to provide a new and useful method of controlling an appliance.

It is yet further an object of the present invention to provide an improved method of controlling an appliance.

It is also an object of the present invention to provide an appliance timer that includes a switching mechanism that enables an upper circuit blade to be utilized for switching of high-current operations.

It is moreover an object of the present invention to provide an appliance timer that reduces erosion and wear of the circuit blades thereof during the useful life of the appliance timer.

The above and other objects, features, and advantages of the present invention will become apparent from the following description and the attached drawings.

DETAILED DESCRIPTION OF THE INVENTION

Figure 1:
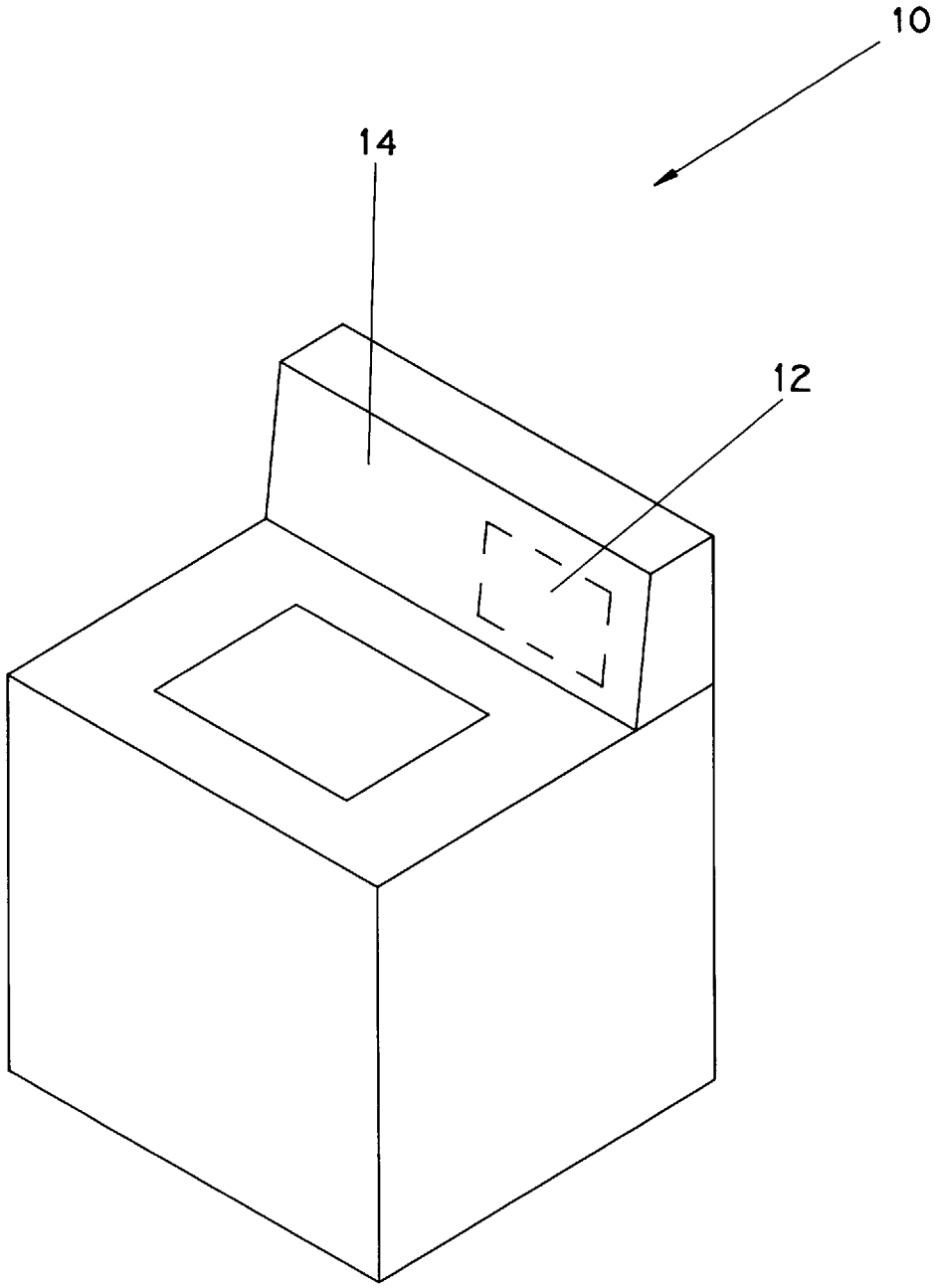
FIG. 1 is a perspective view of an appliance which includes an appliance timer which incorporates the features of the present invention therein.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Referring now to FIG. 1, there is shown an appliance 10 such as clothes washing machine. The appliance 10 includes an appliance timer 12. The appliance timer 12 is secured to a console 14 of the appliance 10.

The appliance timer 12 controls various work functions associated with the appliance 10. Examples of such work functions include agitation, washing, spinning, drying, dispensing detergent or fabric softener, hot water filling, cold water filling, and water draining.

Figure 2:
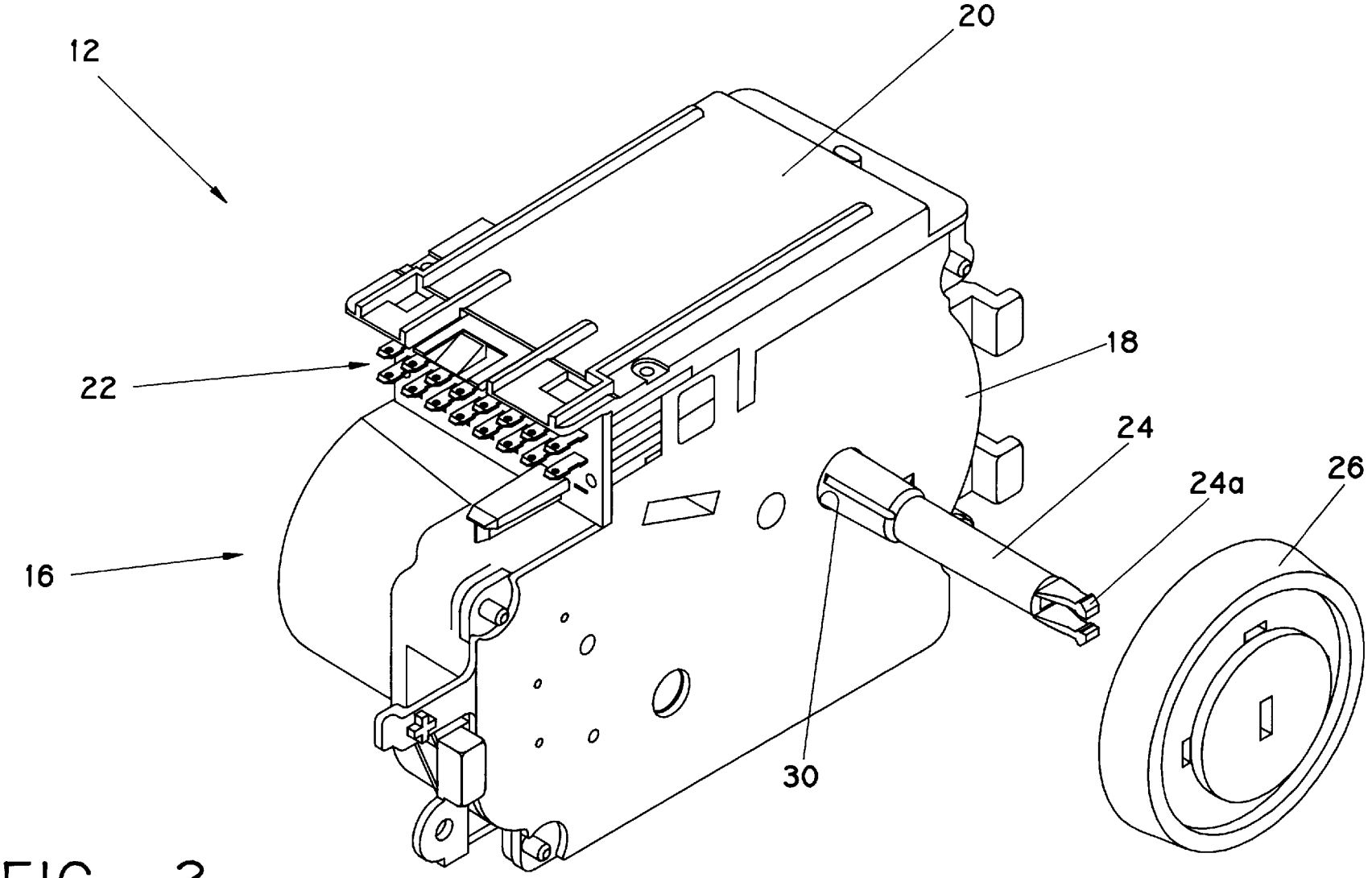
FIG. 2 is a perspective view of the appliance timer of the appliance of FIG. 1.
Figure 3:
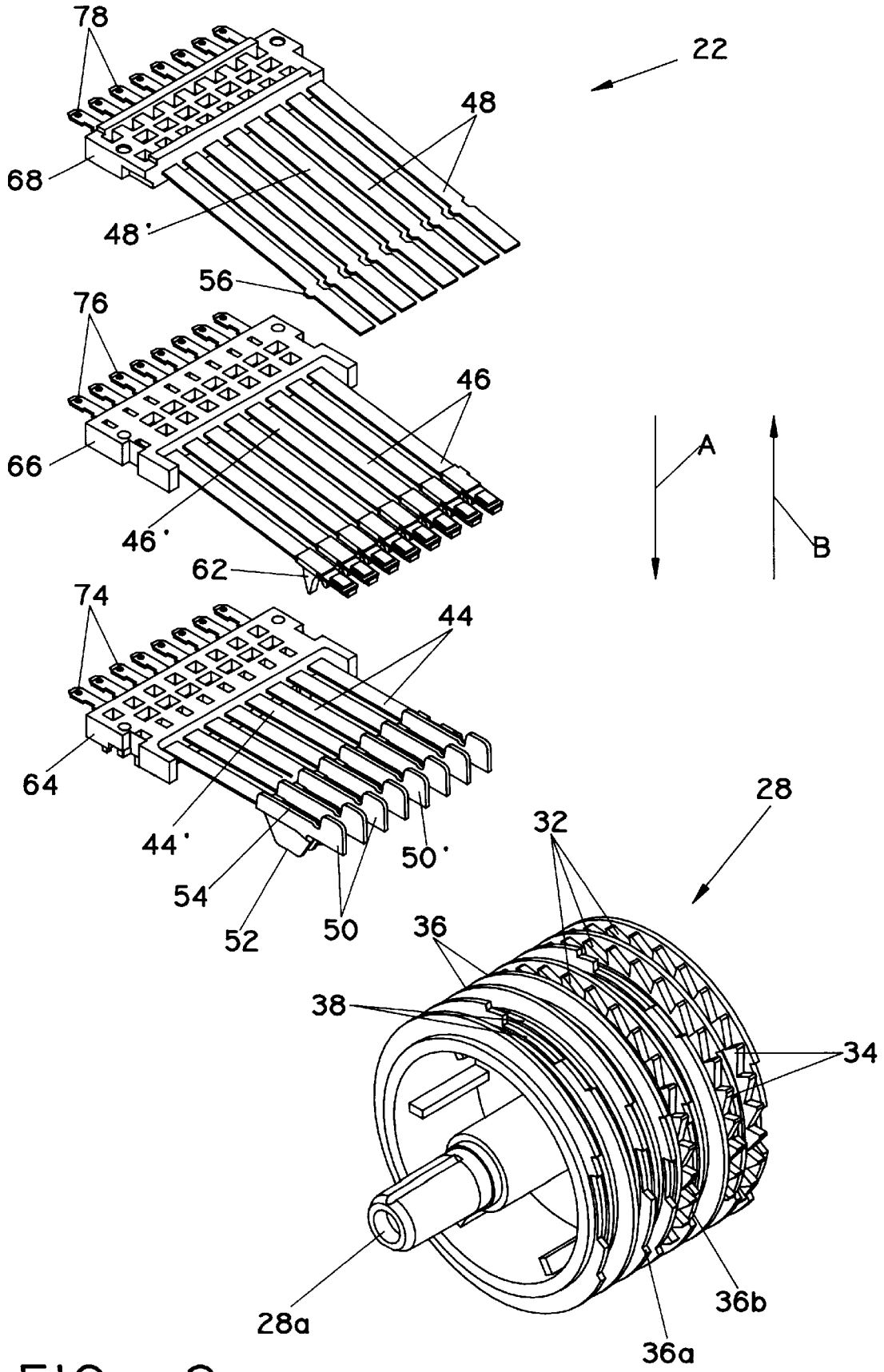
FIG. 3 is an exploded perspective view showing the relationship between the switch assembly and the camstack of the appliance timer of FIG. 2.
Figure 4:
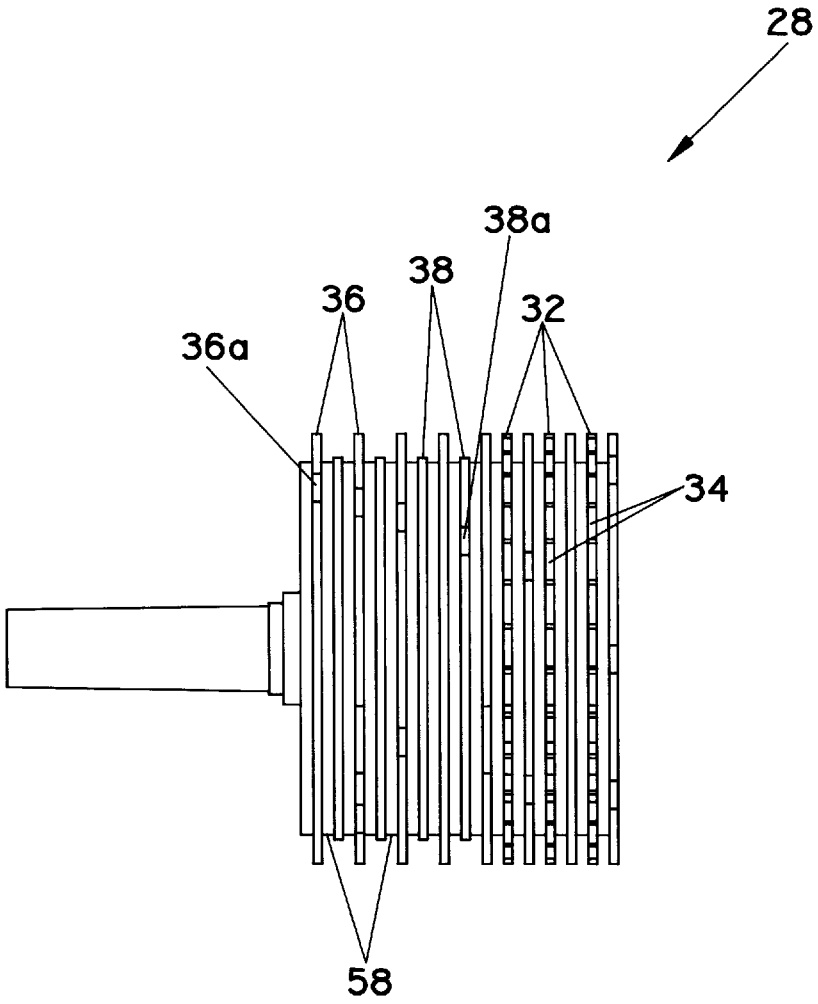
FIG. 4 is a side elevational view of the camstack of the appliance timer of FIG. 2.

Referring now to FIGS. 2–4, there is shown the appliance timer 12 in more detail. The appliance timer 12 includes a housing 16, a side plate 18, a top plate 20, a switch assembly 22, a control shaft 24, a knob 26, and a camstack 28. An operator of the appliance 10 may set the appliance timer 12 to a desired setting by manipulating the knob 26. In particular, the operator of the appliance 10 may push the knob 26 inwardly and thereafter rotate the knob 26 in order to set the appliance timer 12 to a desired setting.

The camstack 28 is secured to the control shaft 24. In particular, the control shaft 24 is received through a central bore 28*a* defined in the camstack 28 in order to be secured thereto. One manner of securing the camstack 28 to the control shaft 24 is with a clutch mechanism (not shown). The control shaft 24 includes a protruding end 24*a* which protrudes from an aperture 30 defined in the side plate 18 of the appliance timer 12 in order to be coupled to the knob 26.

The camstack 28 includes a number of drive blades 32. Each of the drive blades 32 has defined therein a group of ratchet teeth 34. The ratchet teeth 34 cooperate with a drive pawl (not shown) in order to provide for rotation of the camstack 28.

Moreover, the camstack 28 includes a number of program blades 36, 38. The program blade 36 has a number of cam lifts 36*a* and a number of cam drops 36*b* defined therein, whereas the program blade 38 has a number of cam lifts 38*a* defined therein (see FIG. 4). The drive blades 32 are non-rotatably coupled to each of the program blades 36, 38. More specifically, rotation of any of the drive blades 32 causes rotation of each of the program blades 36, 38.

The switch assembly 22 includes a number of lower or first circuit blades 44, a number of intermediate or second circuit blades 46, and a number of upper or third circuit blades 48. Each of the circuit blades 44, 46, 48 are insert molded into a contact wafer 64, 66, 68, respectively. One end of each of the circuit blades 44, 46, and 48 protrudes outwardly from the contact wafers 64, 66, 68, respectively, thereby defining electrical terminals 74, 76, 78, respectively, as shown in FIG. 3. The terminals 74, 76, 78 are provided to electrically couple components associated with the appliance 10 such as a main machine motor and a power source (not shown).

The circuit blades 44, 46, 48 are self-biased in the general direction of arrow A of FIG. 3. Therefore, another end of each of the circuit blades 44, 46, 48 is biased toward the camstack 28 and hence the program blades 36, 38.

Each of the lower circuit blades 44 includes a blade support 50. A contact surface 52 of the blade support contacts a number of camstack valleys 58 (see FIG. 4) defined in the camstack 28. The blade supports 50 are provided to maintain a constant distance between the lower circuit blades 44 and the camstack 28. By maintaining a constant distance between the lower circuit blades 44 and the camstack 28, the blade supports 50 compensate for any tolerance variations and wobble associated with the camstack 28. In addition, the blade supports prevent lateral movement of the lower circuit blades 44.

The blade support 50 also includes a support surface 54. A support tab 56 (see FIG. 3) defined in each of the upper circuit blades 48 is supported by the support surface 54. Therefore, the upper circuit blades 48 are maintained at a predetermined distance away from the lower circuit blades 44 when the intermediate circuit blades 46 are not urged toward the upper circuit blades 48 so as to raise the upper circuit blades away from the support surface 54.

Each of the intermediate circuit blades 46 includes a cam follower 62. The cam follower 62 cooperates with the cam surface 36 thereby allowing the intermediate circuit blades to be moved in the general direction of arrows A and B of FIG. 3. In particular, if the cam follower 62 contacts one of the cam lifts 36*a* of the program blade 36, the cam follower 62 and hence the intermediate circuit blade 46 is urged in the general direction of arrow B of FIG. 3. However, if the cam follower 62 drops into one of the cam drops 36*b* of the program blade 36, the cam follower 62 and hence the intermediate circuit blade 46 is urged in the general direction of arrow A of FIG. 3.

Figure 5:
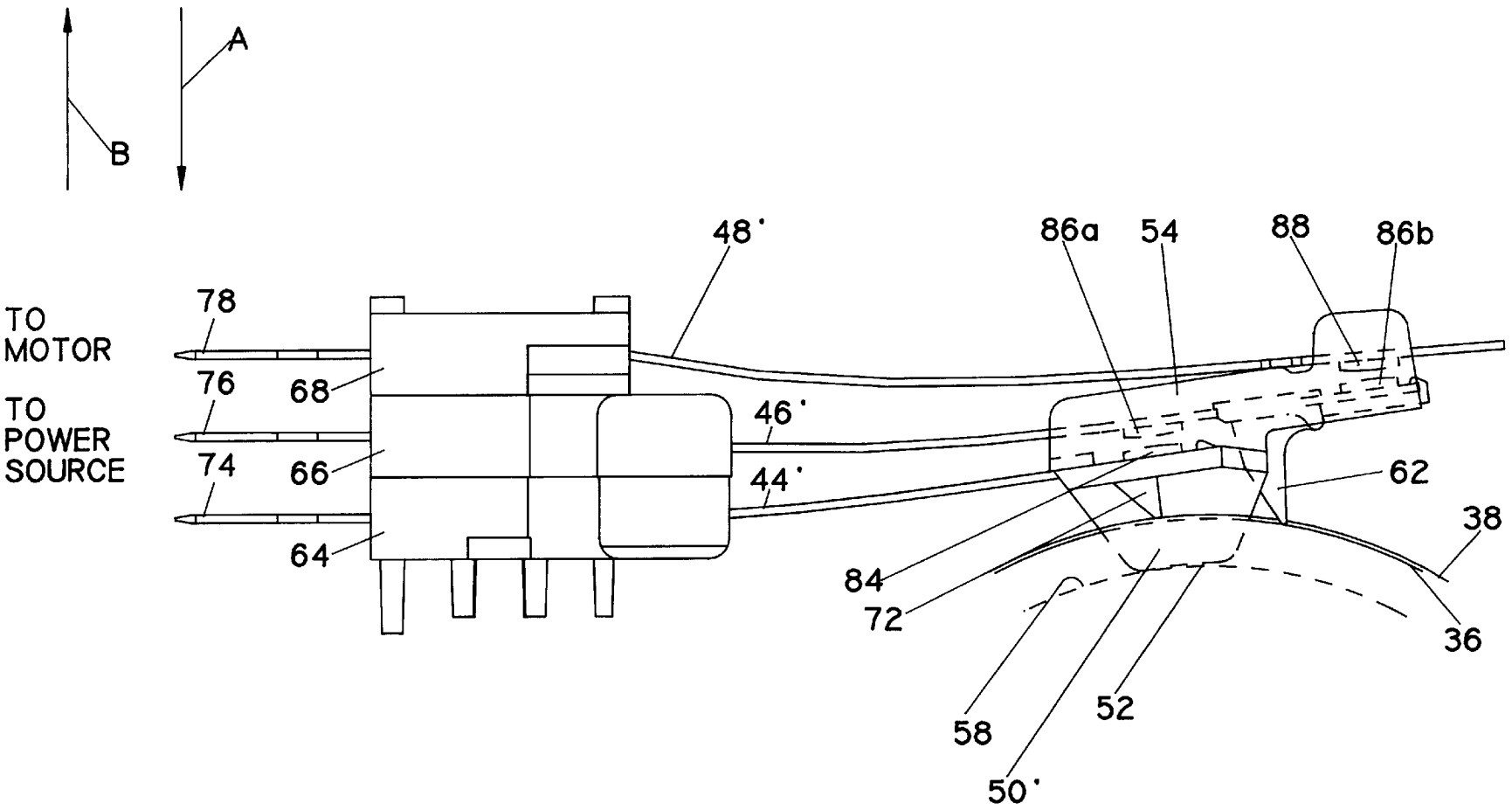
FIG. 5 is a side elevational view showing the circuit blades of the switch assembly of FIG. 3 with each circuit blade being positioned in their respective neutral position.
Figure 6:
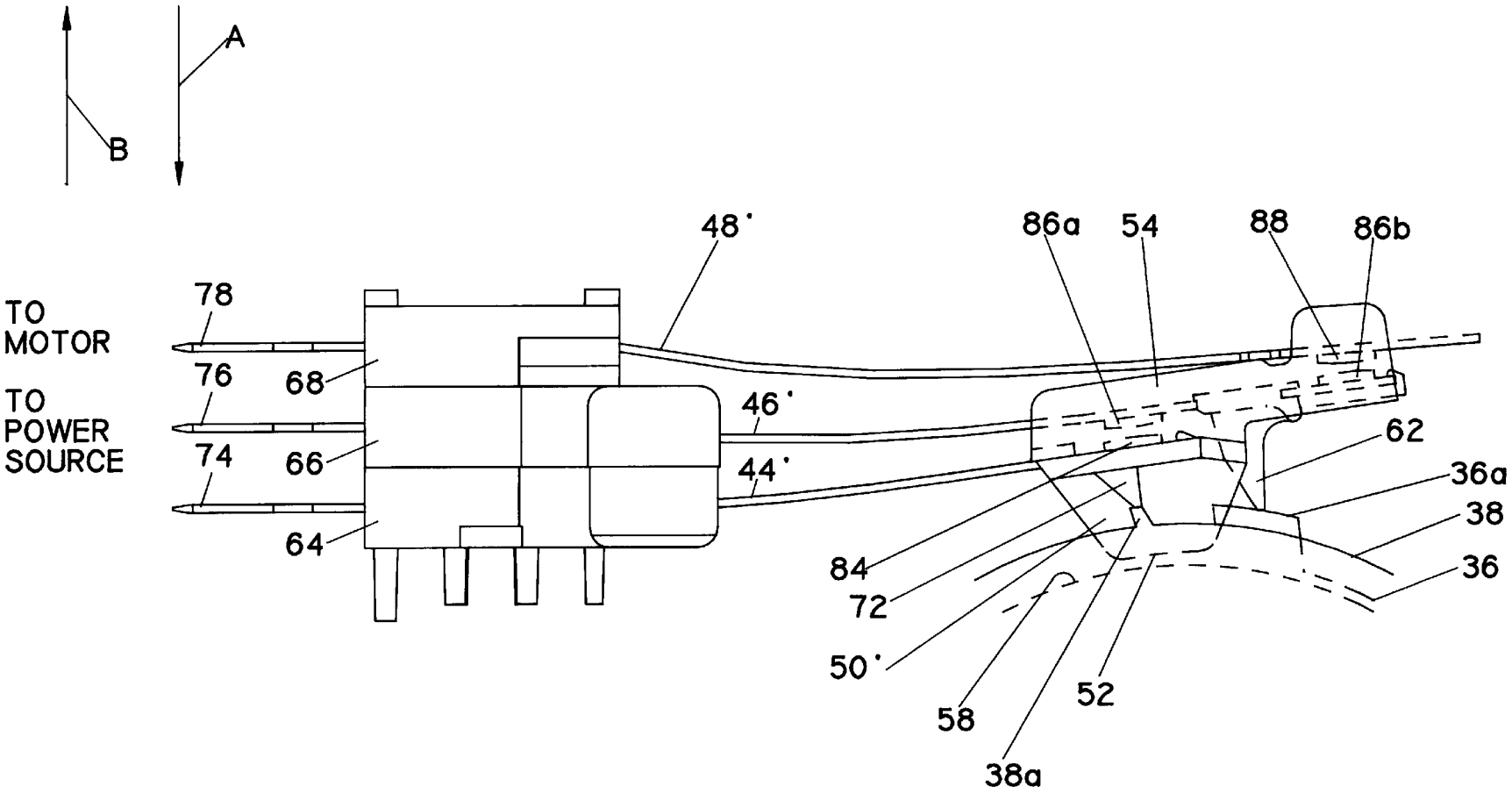
FIG. 6 is a view similar to FIG. 5, but showing the lower and intermediate circuit blades positioned in their respective actuated position, whereas the upper circuit blade is positioned in the first offset position; and, FIG. 7 is a view similar to FIG. 5, but showing (1) the lower circuit blade positioned in the neutral position, (2) the intermediate circuit blade positioned in the actuated position, and (3) the upper circuit blade positioned in the second offset position.
Figure 7:
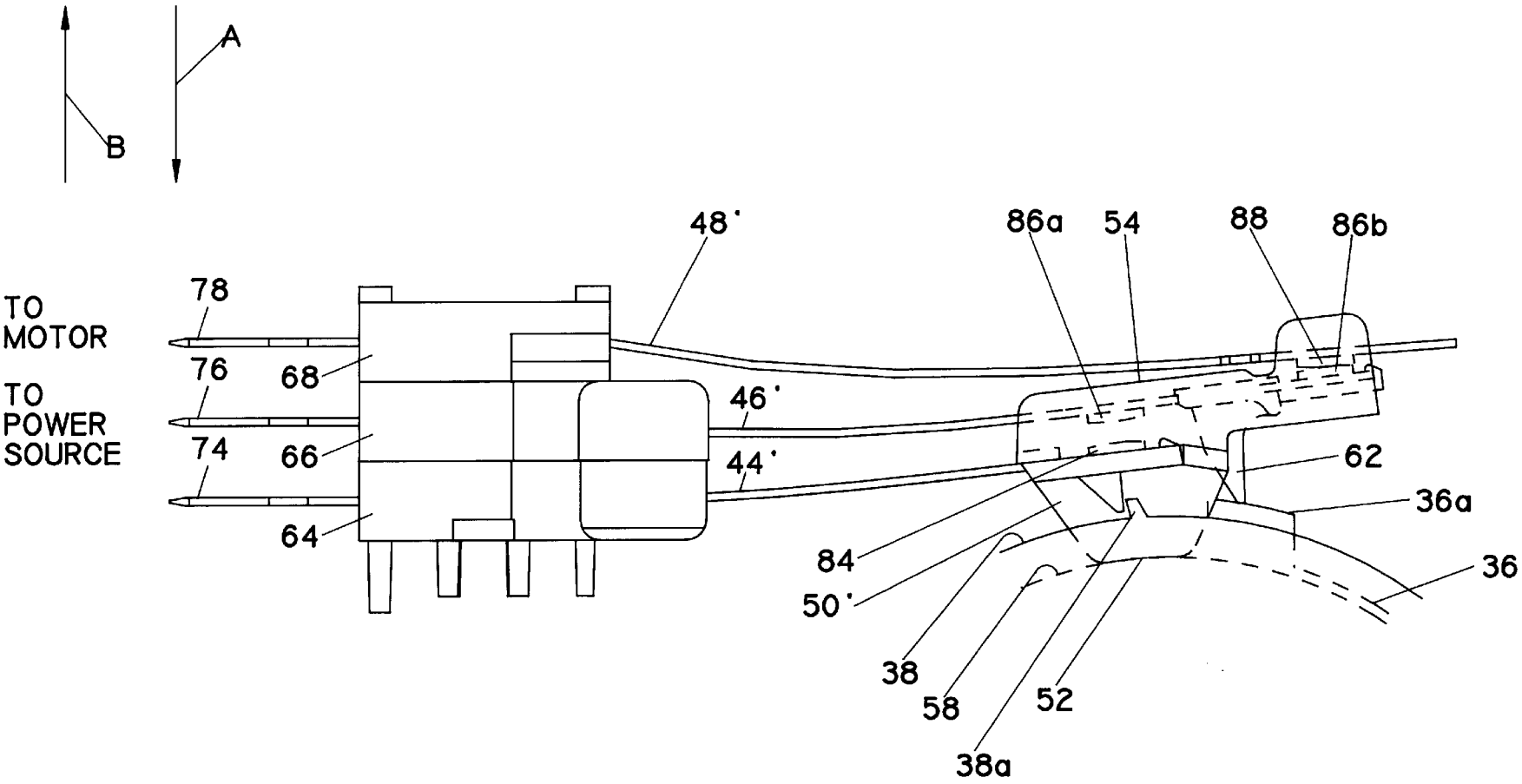

Referring now to FIGS. 5–7, operation of the appliance timer 12 will now be discussed in more detail. Each of the number of circuit blades 44, 46, 48 includes a circuit blade 44', 46', and 48', respectively (see FIG. 3). Only the circuit blades 44', 46', 48' of the circuit blades 44, 46, 48 are shown in FIGS. 5–7 for clarity of description.

Some of the blade supports 50 include a cam follower 72 (see FIG. 5). The blade supports 50 which include a cam follower 72 are hereinafter referred to as a blade support 50'. The cam follower 72 cooperates with the cam surface 38 thereby allowing the lower circuit blade 44' and hence the upper circuit blade 48' (which is supported on the support surface 54 of the blade support 50') to be moved in the general direction of arrow B of FIG. 6. In particular, if the cam follower 72 contacts one of the cam lifts 38*a* of the program blade 38, the cam follower 72 and hence the lower circuit blade 44' and the upper circuit blade 48' are urged in the general direction of arrow B of FIG. 6.

When the cam follower 72 is not in contact with a cam lift 38*a*, the lower circuit blade 44' is positioned in a neutral position thereof, as shown in FIG. 5. When the lower circuit blade 44' is positioned in the neutral position, the contact surface 52 of the blade support 50' contacts the cam valley 58 of the camstack 28. When (1) the lower circuit blade 44' is positioned in the neutral position, and (2) the intermediate circuit blade 46' is not in contact with a cam lift 36*a* (as shall be discussed in more detail below), the upper circuit blade 48' is likewise positioned in a neutral position thereof in which the upper circuit blade 48' is positioned on the support surface 54 of the blade support 50'.

Similarly, when the cam follower 62 is not in contact with a cam lift 36*a* or a cam drop 36*b* (see FIG. 6), the intermediate circuit blade 46' is positioned in a neutral position thereof, as shown in FIG. 5. When (1) the intermediate circuit blade 46' is positioned in the neutral position, and (2) the lower circuit blade 44' and the upper circuit blade 48' are also positioned in their respective neutral positions, the intermediate circuit blade 46' is not in electrical contact with either the lower circuit blade 44' or the upper circuit blade 48'. In particular, when the circuit blades 44', 46', and 48' are each positioned in the respective neutral positions thereof, an electrical contact 84 included in the lower circuit blade 44' is spaced apart from an electrical contact 86*a* included in the intermediate circuit blade 46'. In addition, an electrical contact 88 included in the upper circuit blade 48' is spaced apart from an electrical contact 86*b* included in the intermediate circuit blade 46'.

When the cam follower 72 is in contact with a cam lift 38*a*, the lower circuit blade 44' is positioned in an actuated position thereof, as shown in FIG. 6, in which the lower circuit blade 44' and the upper circuit blade 48' are urged in the general direction of arrow B of FIG. 6. When the lower circuit blade 44' is positioned in the actuated position, the contact surface 52 of the blade support 50' is spaced apart from the cam valley 58 of the camstack 28. In addition, when the lower circuit blade 44' is positioned in the actuated position, the upper circuit blade 48' is positioned in a first offset position thereof in which the upper circuit blade 48' is positioned on the support surface 54 of the lifted blade support 50', as shown in FIG. 6.

Similarly, when the cam follower 62 is in contact with a cam lift 36*a*, the intermediate circuit blade 46' is positioned in an actuated position thereof, as shown in FIG. 6, in which the intermediate circuit blade 46' is urged in the general direction of arrow B of FIG. 6. When (1) the intermediate circuit blade 46' is positioned in the actuated position, (2) the lower circuit blade 44' is positioned in the actuated position, and (3) the upper circuit blade 48' is positioned in the first offset position, the intermediate circuit blade 46' is not in electrical contact with either the lower circuit blade 44' or the upper circuit blade 48'. In particular, the electrical contact 84 of the lower circuit blade 44' is spaced apart from the electrical contact 86*a* of the intermediate circuit blade 46'. In addition, the electrical contact 88 of the upper circuit blade 48' is spaced apart from the electrical contact 86*b* of the intermediate circuit blade 46'.

In order to electrically couple the upper circuit blade 48' to the intermediate circuit blade 46', the cam follower 72 is advanced out of contact with the cam lift 38*a* as shown in FIG. 7. In particular, when the cam follower 72 is advanced out of contact with a cam lift 38*a*, the lower circuit blade 44' drops or otherwise is urged in the general direction of arrow A of FIG. 7 and is again positioned in the neutral position thereof as shown in FIG. 7. When the lower circuit blade 44' is returned to the neutral position, the contact surface 52 of the blade support 50' again contacts the cam valley 58 of the camstack 28.

However, the cam follower 62 of the intermediate circuit blade 46' remains in contact with the cam lift 36*a* thereby preventing the upper circuit blade 48' from likewise being returned to the neutral position thereof. In particular, since the intermediate circuit blade 46' is retained in the actuated position when the upper circuit blade 48' drops, the upper circuit blade 48' is prevented from dropping back into contact with the support surface 54 of the blade support 50', but rather is positioned in a second offset position thereof in which the upper blade 48' is supported by the intermediate blade 46' as shown in FIG. 7.

When (1) the intermediate circuit blade 46' is positioned in the actuated position, and (2) the upper circuit blade 48' is positioned in the second offset position, the intermediate circuit blade 46' is in electrical contact with the upper circuit blade 48'. More specifically, the electrical contact 88 of the upper circuit blade 48' is electrically coupled to the electrical contact 86*b* of the intermediate circuit blade 46.

If it is desirable to electrically decouple the upper circuit blade 48' from the intermediate circuit blade 46', the cam follower 62 is advanced out of contact with the cam lift 36*a*. More specifically, if the cam follower 62 is advanced out of contact with the cam lift 36*a*, the cam follower 62 will drop or otherwise be urged in the general direction of arrow A of FIG. 7 thereby returning the intermediate circuit blade 46' to the neutral position thereof as shown in FIG. 5. When (1) the intermediate circuit blade 46' is returned to the neutral position, and (2) the lower circuit blade 44' is positioned in the neutral position, the upper circuit blade 48' is also returned to the neutral position in which the upper circuit blade 48' is again supported by the support surface 54 of the blade support 50' as shown in FIG. 5.

Alternatively, the upper circuit blade 48' may be electrically decoupled from the intermediate circuit blade 46' by advancing the cam follower 72 into contact with a subsequent cam lift 38*a*. In particular, if the cam follower 72 is advanced into contact with a subsequent cam lift 38*a*, the cam follower 72 will be lifted or otherwise urged in the general direction of arrow B of FIG. 7 thereby returning the lower circuit blade to the actuated position thereof and the upper circuit blade to the first offset position thereof as shown in FIG. 6. When (1) the intermediate circuit blade 46' is positioned in the actuated position, (2) the lower circuit blade 44' is positioned in the actuated position, and (3) the upper circuit blade 48' is positioned in the first offset position, the intermediate circuit blade 46' is not in electrical contact with the upper circuit blade 48'. In particular, the electrical contact 88 of the upper circuit blade 48' is spaced apart from the electrical contact 86*b* of the intermediate circuit blade 46' thereby electrically decoupling the upper circuit blade 48' from the intermediate circuit blade 46'.

From the above description, it should be appreciated that the upper circuit blade 48' and the intermediate circuit blade 46' may be used for switching of high-current operations within the appliance 10. For example, the electrical terminal 76 of the intermediate circuit blade 46' may be electrically coupled to a power source such as a standard 110 V AC outlet 15 (not shown), whereas the electrical terminal 78 of the upper circuit blade 48' may be electrically coupled to a main machine motor of a clothes washing machine (not shown). Therefore, when the upper circuit blade 48' is in contact with the intermediate circuit blade 46' (see FIG. 7), the main machine motor is actuated. Alternatively, when the upper circuit blade 48' is not in contact with the intermediate circuit blade 48' (see FIGS. 5 and 6), the main machine motor is deactuated.

While the invention has been illustrated and described in detail in the drawings and foregoing description, such illustration and description is to be considered as exemplary and not restrictive in character, it being understood that only the preferred embodiment has been shown and described and that all changes and modifications that come within the spirit of the invention are desired to be protected.

For example, although only one of the blade supports 50 of the lower circuit blades 44 (i.e. blade support 50' of the lower circuit blade 44') is shown including the cam follower 72, any number of the blade supports 50 may be configured to include a cam follower 72.

In addition, while the foregoing description has described the cam followers 62, 72 as being advanced into and out of contact with the cam lifts 36*a*, 38*a*, respectively, it should be appreciated that advancement of the cam followers 62, 72 into and out of contact with the cam lifts 36*a*, 38*a*, respectively, is caused by rotation of the camstack 28 while the cam followers 62, 72 are maintained in a fixed position adjacent to the rotating camstack 28. However, many of the advantageous of the present invention may also be achieved by moving the cam followers 62, 72 while the camstack 28 and hence the cam lifts 36*a*, 38*a* are maintained in a fixed position adjacent to the moving cam followers 62, 72.

Moreover, although the cam surfaces 36, 38 are described as being defined in the camstack 28, it should be appreciated that the cam surfaces may be defined in other types of cam mechanisms. For example, the cam surfaces 36, 38 may be defined in a flat cam, such as those commonly known as a "pancake" cam, in which the cam surfaces 36, 38 are concentric about a center of rotation of the flat cam.

What is claimed is:

1. A timer for controlling an appliance, comprising:

a cam having a first cam surface and a second cam surface defined therein, said first cam surface being distinct from said second cam surface;

a first circuit blade having a first cam follower attached thereto, said first cam follower cooperates with said first cam surface so as to move said first circuit blade between a first neutral position and a first actuated position;

a second circuit blade having a second cam follower attached thereto, said second cam follower cooperates with said second cam surface so as to move said second circuit blade between a second neutral position and a second actuated position; and a third circuit blade which is positionable in a first offset position, a second offset position, and a third neutral position;

wherein (1) said third circuit blade is positioned at said first offset position when said first circuit blade is positioned at said first actuated position, (2) said third circuit blade is moved from said first offset position to said second offset position when said first circuit blade is moved from said first actuated position to said first neutral position and said second circuit blade is positioned at said second actuated position, and (3) said third circuit blade contacts said second circuit blade when said third circuit blade is positioned in said second offset position and said second circuit blade is positioned in said second actuated position.

2. The timer of claim 1, wherein:

said first cam surface includes a first cam lift defined thereon, advancement of said first cam follower into contact with said first cam lift causes said first circuit blade to be moved from said first neutral position to said first actuated position, and advancement of said first cam follower out of contact with said first cam lift causes said first circuit blade to be moved from said first actuated position to said first neutral position.

3. The timer of claim 2, wherein:

said second cam surface includes a second cam lift defined thereon, advancement of said second cam follower into contact with said second cam lift causes said second circuit blade to be moved from said second neutral position to said second actuated position, and advancement of said second cam follower out of contact with said second cam lift causes said second circuit blade to be moved from said second actuated position to said second neutral position.

4. The timer of claim 2, wherein:

said first circuit blade includes a blade support, and said third circuit blade is biased against said blade support when said first circuit blade is located at said first actuated position and said third circuit blade is located at said first offset position.

5. The timer of claim 1, wherein:

said second circuit blade includes a first electrical contact, said third circuit blade includes a second electrical contact, and said first electrical contact contacts said second electrical contact when said third circuit blade is positioned in said second offset position and said second circuit blade is positioned in said second actuated position.

6. The timer of claim 5, wherein:

said second circuit blade includes a first electrical terminal, said third circuit blade includes a second electrical terminal, said first electrical terminal is electrically coupled to a power source, and said second electrical terminal is electrically coupled to an appliance motor.

7. The timer of claim 6, wherein:

said appliance motor is electrically coupled to said power source when said first electrical contact contacts said second electrical contact.

8. The timer of claim 1, wherein:

said cam includes a camstack having a first program blade and a second program blade, said first cam surface is defined in said first program blade, and said second cam surface is defined in said second program blade.

9. A method of operating an appliance timer which includes a cam having a first cam lift and a second cam lift each defined therein, with the first cam lift being distinct from the second cam lift, comprising the steps of:

(a) moving a first circuit blade from a first neutral position to a first actuated position so as to cause movement of a third circuit blade from a third neutral position to a first offset position, wherein step (a) includes the step of advancing a first cam follower which is attached to said first circuit blade into contact with said first cam lift such that said first circuit blade is moved from the first neutral position to the first actuated position;

(b) moving a second circuit blade from a second neutral position to a second actuated position, wherein step (b) includes the step of advancing a second cam follower which is attached to said second circuit blade into contact with said second cam lift such that said second circuit blade is moved from the second neutral position to the second actuated position; and (c) moving said first circuit blade from said first actuated position to said first neutral position when said second circuit blade is positioned at said second actuated position so as to cause movement of said third circuit blade from said first offset position to a second offset position such that said third circuit blade contacts said second circuit blade.

10. The method of claim 9, wherein:

said third circuit blade is positioned above said second circuit blade, and step (c) includes the step of moving said third circuit blade downwardly into contact with said second circuit blade.

11. The method of claim 9, further comprising the step of:

(d) moving said second circuit blade from said second actuated position to said second neutral position when said first circuit blade is positioned at said first neutral position so as to cause movement of said third circuit blade from said second offset position to said third neutral position such that said third circuit blade moves out of contact with said second circuit blade.

12. The method of claim 9, wherein:

said second circuit blade includes a first electrical contact, said third circuit blade includes a second electrical contact, and step (c) includes the step of moving said second electrical contact into contact with said first electrical contact.

13. The method of claim 12, wherein:

said second circuit blade includes a first electrical terminal, said third circuit blade includes a second electrical terminal, said first electrical terminal is electrically connected to a power source, said second electrical terminal is electrically connected to an appliance motor, and said appliance motor is electrically connected to said power source when said first electrical contact is positioned in contact with said second electrical contact.

14. A method of operating an appliance timer, comprising the steps of:

(a) providing a camstack having a first cam surface and a second cam surface which are distinct from each other, said first cam surface including a first cam lift defined therein, and said second cam surface including a second cam lift defined therein, (b) rotating said camstack so that said first cam lift contacts a first cam follower attached to a first circuit blade so as to cause said first circuit blade to be moved from a first neutral position to a first actuated position;

(c) rotating said camstack so that said second cam lift contacts a second cam follower attached to a second circuit blade so as to cause said second circuit blade to be moved from a second neutral position to a second actuated position;

(d) moving a third circuit blade from a third neutral position to a first offset position in response to step (b);

(e) rotating said camstack so that said first cam lift is advanced out of contact with said first cam follower of said first circuit blade after step (b) so as to cause said first circuit blade to be moved from said first actuated position to said first neutral position; and (f) moving said third circuit blade from said first offset position to a second offset position in response to step (e) while said second circuit blade is located at said second actuated position.

15. The method of claim 14, wherein:

said second circuit blade includes a first electrical contact, said third circuit blade includes a second electrical contact, and step (f) includes the step of moving said second electrical contact into contact with said first electrical contact.

16. The method of claim 15, wherein:

said second circuit blade includes a first electrical terminal, said third circuit blade includes a second electrical terminal, said first electrical terminal is electrically connected to a power source, said second electrical terminal is electrically connected to an appliance motor, and said appliance motor is electrically connected to said power source when said first electrical contact is positioned in contact with said second electrical contact.

17. The method of claim 14, further comprising the steps of:

(g) rotating said camstack so that said second cam lift is advanced out of contact with said second cam follower of said second circuit blade after step (c) so as to cause said second circuit blade to be moved from said second actuated position to said second neutral position; and (h) moving said third circuit blade from said second offset position to said third neutral position in response to step (g) while said first circuit blade is located at said first neutral position.

* * * * *